US009767628B2

(12) United States Patent
Goldman

(10) Patent No.: US 9,767,628 B2
(45) Date of Patent: Sep. 19, 2017

(54) ACCESS CONTROL DEVICE FOR DELIVERING CODED KNOCKS

(71) Applicant: KNOCK N'LOCK LTD., Yokneam (IL)

(72) Inventor: Ilan Goldman, Herzliya (IL)

(73) Assignee: KNOCK N'LOCK LTD., Yokneam (IL)

( * ) Notice: Subject to any disclaimer, the term of this patent is extended or adjusted under 35 U.S.C. 154(b) by 0 days.

(21) Appl. No.: 15/030,390

(22) PCT Filed: Oct. 6, 2014

(86) PCT No.: PCT/IL2014/050875

§ 371 (c)(1),
(2) Date: Apr. 19, 2016

(87) PCT Pub. No.: WO2015/059689

PCT Pub. Date: Apr. 30, 2015

(65) Prior Publication Data

US 2016/0260268 A1 Sep. 8, 2016

Related U.S. Application Data

(60) Provisional application No. 61/893,615, filed on Oct. 21, 2013.

(51) Int. Cl.
*G07C 9/00* (2006.01)

(52) U.S. Cl.
CPC ..... *G07C 9/00007* (2013.01); *G07C 2009/00746* (2013.01); *G07C 2009/00761* (2013.01); *G07C 2009/00801* (2013.01)

(58) Field of Classification Search
CPC ..... G07C 2009/00746
See application file for complete search history.

(56) References Cited

U.S. PATENT DOCUMENTS

| | | | |
|---|---|---|---|
| 6,411,195 | B1 | 6/2002 | Goldman |
| 6,848,314 | B2 | 2/2005 | Goldman |
| 2012/0229253 | A1 | 9/2012 | Kolar |

FOREIGN PATENT DOCUMENTS

| | | | |
|---|---|---|---|
| CN | 201963070 | U | 9/2011 |
| EP | 1327963 | A1 | 1/2002 |
| EP | 1543208 | | 6/2005 |
| EP | 1599651 | | 11/2005 |
| WO | 2004020767 | A1 | 3/2004 |
| WO | 2004079136 | A1 | 9/2004 |

*Primary Examiner* — Daniell L Negron
(74) *Attorney, Agent, or Firm* — Paul D. Bianco; Gary S. Winer; Fleit Gibbons Gutman Bongini & Bianco PL

(57) ABSTRACT

This disclosure provides a device for delivering coded data in the form of knocks, comprising an electric motor capable of bi-directional rotation, a control utility to command the motor to alternately rotate in two opposite directions; a knocking element coupled to the motor such so as to be rotated thereby; and an anvil element positioned so as to being successively impacted by the knocking element in each of the two rotational directions.

7 Claims, 3 Drawing Sheets

ACCESS CONTROL DEVICE FOR DELIVERING CODED KNOCKS

TECHNOLOGICAL FIELD

The invention concerns a data transmission device for delivering data in the form of a series of encoded knocks.

PRIOR ART

References considered to be relevant as background to the presently disclosed subject matter are listed below:

U.S. Pat. No. 6,411,195

U.S. Pat. No. 6,848,314

Acknowledgement of the above references herein is not to be inferred as meaning that these are in any way relevant to the patentability of the presently disclosed subject matter.

BACKGROUND

U.S. Pat. No. 6,411,195 describes a device that is configured for delivering a code in the form of a series of knocks. The device of this patent has an impeller head that is capable of reciprocation to thereby transmit an encoded series of discrete mechanical impacts to a surface of an impact transmissive body. An impact sensitive transducer is configured for picking-up the vibrations and decoding the data therefrom. A particular example of this device is for access control.

U.S. Pat. No. 6,848,314 describes a device for receiving data transmitted as impulses through an input transmission body. The device has a vibration sensitive transducer which constitutes part of a floating mass assembly with a pick-up portion. The pick-up portion is biased towards a surface of a rigid body that is either the input transmission body or a vibrations transmissive member. The assembly has a freedom of movement permitting it to vibrate independently from the rigid body.

GENERAL DESCRIPTION

In accordance with the invention a new access control device for delivering coded data in the form of knocks is provided. By the use of the access control device of the invention, the rate of transmission of the knocks-coded data to an impact transmissive object is increased as compared to the art noted above.

The access control device of the invention comprises an electric motor, a control utility, a knocking element and an anvil element. The electric motor is of a kind that is capable of bi-directional rotation. The control utility is associated with the motor and is configured for commanding it to alternately rotate in two opposite directions. The knocking element is coupled to the motor such so as to be rotated thereby in the two opposite rotational directions. The anvil element has leading face that protrudes outwardly out of a face of the access control device and is configured so as to permit it to come into contact with a knock-receiving surface of a body (e.g. a body of a lock) on which the knocks should be impacted. The anvil element and the knocking element are fitted so as to permit the latter to impact a surface of the former, e.g. a surface that is opposite to the leading face, so as to be successively impacted by the knocking element in each of the two rotational directions. The coded data is encoded by the control utility into a series of successive command signals for opposite rotations of the motor and thereby into successive knocks.

As may be appreciated the fact that in each operational cycle (which involves rotation in one direction and then in the opposite direction) the knocking element impacts the anvil element twice; in distinction to the above-noted prior art in which each operational cycle yields a single knock. This fact by itself may increase the knocking rate. Furthermore, also the bi-directional rotational movement does not require operation against the bias of a spring as in the linear reciprocal movement in the prior art coded-knocking device, which may also impact the rate. Additionally, the rotational movement of the motor improves the accuracy of the knocks and hence the interval between successive knocks may be reduced. These factors are among those that cause an increase in rate. This increase in rate, in addition to permitting a shorter knocking pulse, also allows transmitting a significantly larger volume of data in a given time period.

By an embodiment of the invention the data is encoded in the form of intervals between successive knocks.

By an embodiment of the invention the device comprises a user interface for inputting data.

By an embodiment of the invention the anvil element is fitted on top of one or more elastic elements (e.g. springs) configured for outwardly biasing the anvil element. The one or more elastic elements may, for example, be two springs or perhaps four. In such an arrangement, when the leading face of the anvil element is pressed against the knock-receiving surface, the anvil element may be slightly retracted into the body of the device against the biasing force of the one or more elastic elements. This brings to a firmer contact of the anvil element with the knock receiving surface.

By an embodiment of the invention, pressing the leading face against the knock-receiving surface serves as a trigger for operation of the access control device. By one embodiment, the anvil element is associated with a microswitch and the retraction of the anvil element against the bias of the elastic element engages the microswitch. This may induce the control utility to activate the motor to rotate in opposite directions to thereby deliver the knock-coded access control code and optionally other data. Alternatively, the control utility may initially seek the code, e.g. via Bluetooth communication from and adjacent communication device, and then cause its delivery upon receipt.

By another embodiment the leading face of the anvil element may be a pressure-sensitive surface linked to the control utility and function in a manner analogous to that described above in relation to the microswitch.

The access control device may also comprise a receiver (e.g. a infrared receiver, RFID receiver, NFC receiver, Bluetooth receiver, receiver for receiving data over a cellular network or through radio communication, etc.) for receiving data from an external source (e.g. a portable computer, a communication device, a cellular phone, a central controller communicating through remote communication infrastructure, etc.); and at times with a transmitter or transceiver for both receiving data from and transmitting data to an external source. By way of example, an access control code may be stored in or transmitted to a cellular communication device and delivered therefrom to the access control device by a Bluetooth communication protocol.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

Figure 1:
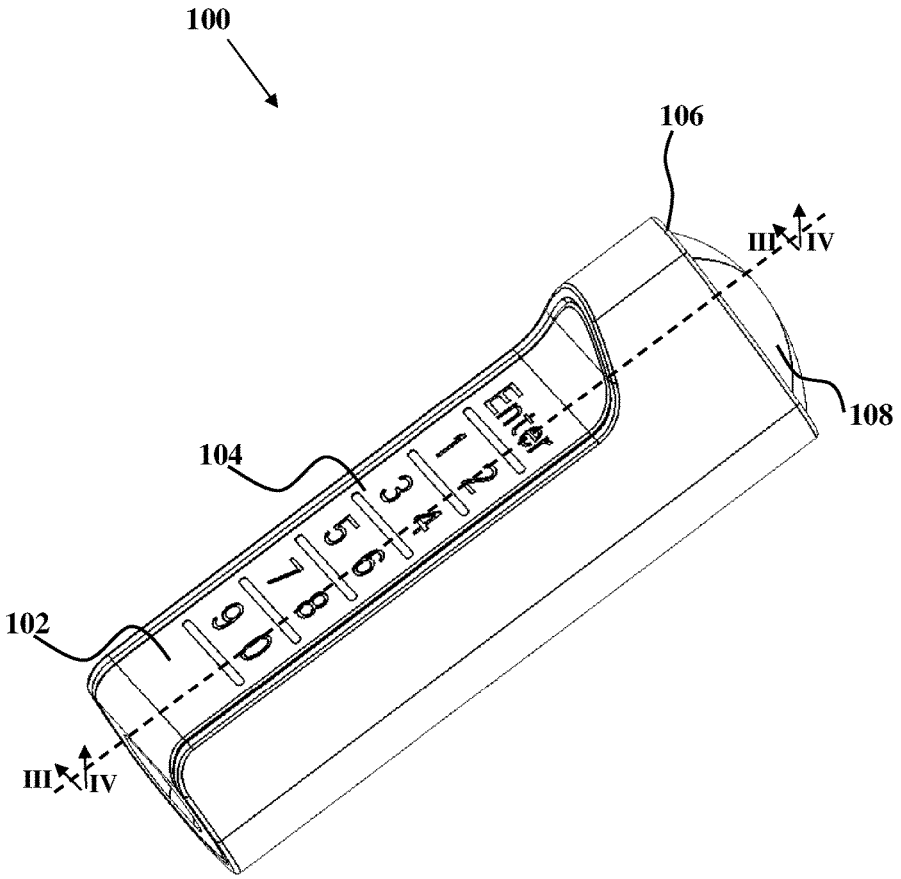
FIG. 1 shows an external perspective view of a device according to an embodiment of the invention.

FIG. 1 shows an access control device 100 in accordance with an embodiment of the invention for delivering coded data in the form of knocks. The top face of the device 102 includes a keyboard 104, which is a user interface permitting a user to input a certain numeric code, which is then encoded by the device into a series of knocks. The user interface, as may be appreciated, may have a variety of other configurations, for example it may be in the form of a touch-screen, it may include letter keys, keys of other signs, etc. In other exemplary configurations, the user interface may be in the form of a finger-print scanner and reader, which may be used to verify the identity of the user, or may even convert a finger-print into a specific, user-related knock-code.

Seen at the front end and protruding out of the front face 106 of the device is a leading face 108 of a metal block that is the front end of an anvil element 110.

Figure 2:
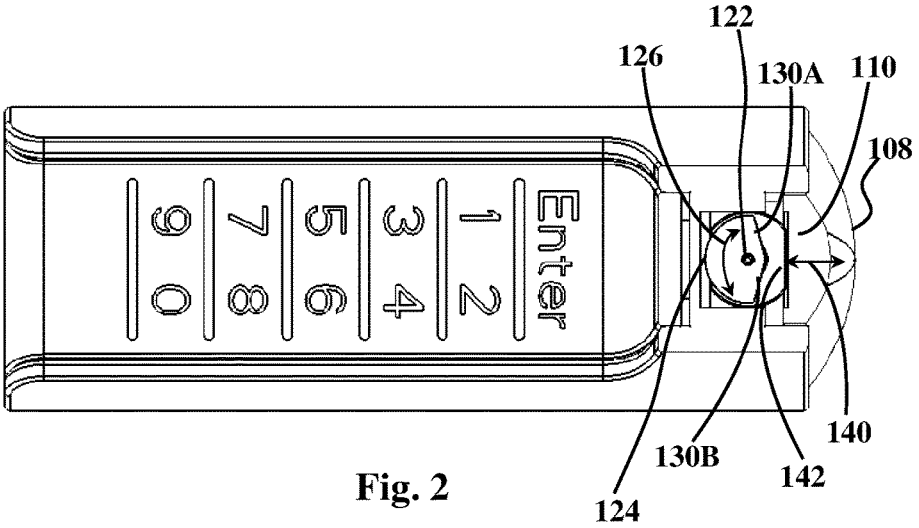
FIG. 2 shows the device of FIG. 1 with some of its upper cover removed to show internal parts.
Figure 3:
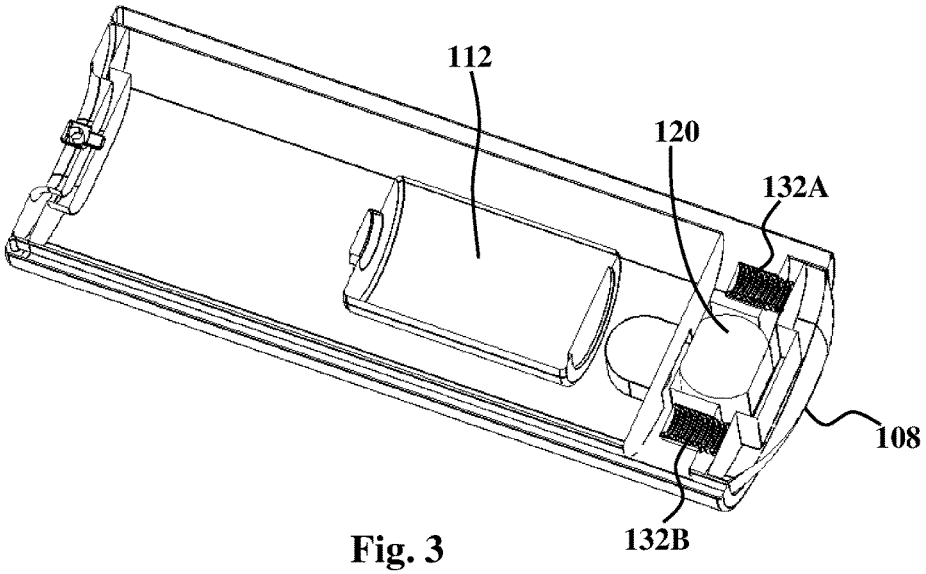
FIG. 3 shows a cross-section through the plane defined by the two arrows marked III.
Figure 4:
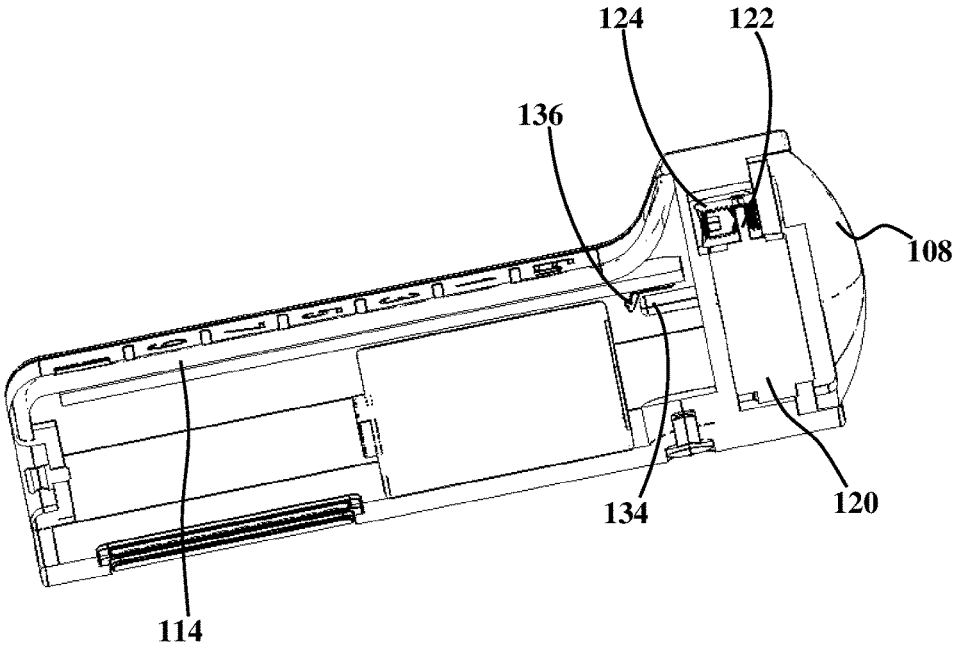
FIG. 4 shows a cross-section through the plane defined by the two arrows marked IV.

As can be seen in FIG. 2-4, the device houses a battery 112, has an electronic control utility 114 linked to keyboard 104. Housed within the device is an electric motor 120 (shown as a block without showing its internal components) which is coupled by an axle 122 to a knocking element 124. The electric motor 120 is associated with the control utility 114 (the manner of association not being illustrated) and this association permits utility 114 to issue command signals to induce alternating, bi-directional rotations of motor 120, as represented by arrow 126 (seen in FIG. 2); and consequently, the knocking element 124 reciprocates alternately in these two rotational directions. Element 124 has two impacting faces 130A, 130B which in the respective opposite rotational states successively impact on the rear face 142 of anvil element 110—namely face 130B will impact the rear face 142 of anvil element 110 in succession after face 130A and vice versa.

When face 108 of anvil element 110 is pressed against a knock-receiving surface of an impact transmissive body (not shown), the impact between impact faces 130A, 130B and the rear face 142 of anvil element 110, is then transmitted as a mechanical vibration to said body. This body may be a surface of a door, a lock, a safe, etc., which includes a pick-up element for picking up the vibrations coupled to a data decoding utility that decodes the data and is responsive thereto. A typical example is access control by which an appropriate code causes opening of the lock, safe, etc.

In a typical embodiment, anvil element 110 can reciprocate in a longitudinal direction represented by arrow 140 against the biasing force of springs 132A and 132B, or any other type of elastic element. The anvil element 110 of this embodiment has a rearward extending arm 134, which has rear end that is in close association with microswitch 136 such that the retraction of the anvil element causes said rear end to engage the microswitch. Once engaged, the microswitch triggers the control utility to issue a knocks' code. Thus, a typical operation is for a user to enter the code by the use of the user interface 104 (which in this example is inputted via a keyboard, but the code may also be transmitted from a user-held mobile device, or generated following a scan of the user's finger-print), and then face 108 is placed against the respective body and pressed. Upon such pressure, the anvil element retracts, the micro-switch is activated and triggers the release of the series of knocks. As can be appreciated, once pressed, the rear face 142 of the anvil element 110 is then positioned more proximal to the knocking element 126, to that which is seen in FIG. 2. Optionally, as a safety measure, if the microswitch is not engaged within a defined time window after inputting the code, the control utility is reset and in order to activate it a new code needs then be entered.

The invention claimed is:

1. A device for delivering coded data in the form of knocks, the device comprising:

an electric motor capable of bi-directional rotation;

a control utility associated with the motor to command it to alternately rotate in two opposite directions;

a knocking element coupled to the motor such so as to be rotated thereby; and an anvil element positioned so as to being successively impacted by the knocking element in each of the two rotational directions and having a leading face protruding outwardly from a surface of the device and configured for contact with a knocks-receiving surface;

the coded data being encoded by the control utility into a series of successive command signals for opposite rotations of the motor and thereby into successive knocks.

2. The device of claim 1, wherein the data is encoded in the form of intervals between successive knocks.

3. The device of claim 1, comprising a user interface for inputting data.

4. The device of claim 1, comprising a receiver or transceiver for receiving data from an external source.

5. The device of claim 1, wherein the anvil element is fitted on top of one or more elastic elements configured for outwardly biasing the anvil element.

6. The device of claim 5, wherein the elastic elements are springs.

7. The device of claim 1, wherein pressing of the leading face of the anvil element against the knocks-receiving surface, activates the device.

* * * * *